US011306505B2

(12) United States Patent
Lin

(10) Patent No.: US 11,306,505 B2
(45) Date of Patent: Apr. 19, 2022

(54) LOCK

(71) Applicant: LINTEX CO., LTD., Zhanghua County (TW)

(72) Inventor: Chia-Sheng Lin, Zhanghua County (TW)

(73) Assignee: LINTEX CO., LTD., Zhanghua County (TW)

( * ) Notice: Subject to any disclaimer, the term of this patent is extended or adjusted under 35 U.S.C. 154(b) by 329 days.

(21) Appl. No.: 16/561,281

(22) Filed: Sep. 5, 2019

(65) Prior Publication Data

US 2020/0270899 A1 Aug. 27, 2020

(30) Foreign Application Priority Data

Feb. 22, 2019 (TW) ..... 108202249

(51) Int. Cl.
*E05B 17/00* (2006.01)
*E05B 27/00* (2006.01)

(52) U.S. Cl.
CPC ..... *E05B 17/0004* (2013.01); *E05B 27/005* (2013.01)

(58) Field of Classification Search
CPC ..... E05B 9/084; E05B 9/086; E05B 13/108; E05B 17/0004; E05B 27/005
USPC ..... 70/367, 369–371, 466
See application file for complete search history.

(56) References Cited

U.S. PATENT DOCUMENTS 1,487,307 A * 3/1924 Best ..... E05B 9/086 70/369
1,882,626 A * 10/1932 Jacobi ..... E05B 9/084 70/369
1,905,639 A * 4/1933 Jacobi ..... E05B 9/084 70/369
1,969,010 A * 8/1934 Jacobi ..... E05B 9/086 70/369
1,979,938 A * 11/1934 Jacobi ..... E05B 9/086 70/369
2,059,678 A * 11/1936 Briggs ..... E05B 9/086 70/369
2,061,456 A * 11/1936 Falk ..... E05B 9/086 70/369
2,065,683 A * 12/1936 Gahagan ..... E05B 9/086 70/369
2,097,189 A * 10/1937 Jacobi ..... E05B 9/086 70/368

(Continued)

*Primary Examiner* — Suzanne L Barrett
(74) *Attorney, Agent, or Firm* — Muncy, Geissler, Olds & Lowe, PC

(57) ABSTRACT

A lock is provided, including a sleeve member, a main body and an engaging member. The main body is rotatably disposed in the sleeve member and has a first connecting portion, one of the main body and the sleeve member has a slide slot which extends along an axial direction and the other has a protrusive block, when the protrusive block corresponds to the slide slot in the axial direction, the main body is movable relative to detachable from the sleeve member. The engaging member is rotatably disposed in the sleeve member and has a second connecting portion, one of the engaging member and the main body has a hook and the other has a slot, when the first and second connecting portions are assembled to each other, the engaging member and the main body are co-rotatable, and the hook is engaged with the slot.

9 Claims, 9 Drawing Sheets

(56) References Cited

U.S. PATENT DOCUMENTS

| | | | | | |
|---|---|---|---|---|---|
| 2,097,190 | A * | 10/1937 | Jacobi | E05B 9/086 | 70/368 |
| 3,589,152 | A * | 6/1971 | Glass | E05B 63/0017 | 70/81 |
| 4,099,397 | A * | 7/1978 | Dauenbaugh | E05B 9/084 | 70/371 |
| 4,512,166 | A * | 4/1985 | Dunphy | E05B 29/0013 | 70/366 |
| 5,285,667 | A * | 2/1994 | Fukasawa | E05B 17/04 | 70/360 |
| 6,978,645 | B2 * | 12/2005 | Shimon | E05B 17/0058 | 70/379 R |
| 7,918,111 | B2 * | 4/2011 | Uliano | E05B 67/36 | 70/32 |
| 2003/0188558 | A1 * | 10/2003 | Shiao | E05B 9/084 | 70/369 |
| 2017/0350163 | A1 * | 12/2017 | Ma | E05B 27/005 | |

* cited by examiner

LOCK

BACKGROUND OF THE INVENTION

Field of the Invention

The present invention relates to a lock.

Description of the Prior Art

Generally, to prevent others from opening your private objects or entering your room, the most direct way is to assemble a lock on an object to be opened. The conventional lock includes a sleeve member which is fixedly disposed on an object to be opened and a main body of the lock which is inserted in the sleeve member and rotatable, an end of the main body is connected to a block member, and the main body can be actuated to rotate via the key so as to form a release or locked relation between the block member and the object to be opened. When the block member and the object to be opened are in a locked relation, the block member and the object to be opened interfere with each other, the object to be opened cannot be opened easily so as to protect people and prevent objects from being stolen.

However, there is an existing problem in the conventional lock, when a user lost the key of the lock accidently, s/he might need to change the lock in case that others get the key and steal the object to be opened. The main body is undetachably assembled on the sleeve member, so the sleeve member and the main body need to be disassembled together to be replaced. The replacement process is very complicated, and the cost is high, so there is room for improvements.

The present invention has arisen to mitigate and/or obviate the afore-described disadvantages.

SUMMARY OF THE INVENTION

The major object of the present invention is to provide a lock, a main body of the lock can be singularly disassembled, so there is no need to disassemble the main body along with a sleeve member from an object to replace a new main body to prevent from being stolen.

To achieve the above and other objects, a lock is provided, including a sleeve member, a main body and an engaging member. The sleeve member defines an axial direction and is for being fixed on an object. The main body is rotatably disposed in the sleeve member and has a first connecting portion, one of an outer wall of the main body and an inner wall of the sleeve member has a slide slot which extends along the axial direction, the other of the outer wall of the main body and the inner wall of the sleeve member has a protrusive block, when the protrusive block corresponds to the slide slot in the axial direction, the main body is movable relative to the sleeve member along the axial direction to be detached from the sleeve member. The engaging member is rotatably disposed in the sleeve member, one end of the engaging member facing the main body has a second connecting portion, one of the engaging member and the main body has a hook, the other of the engaging member and the main body has a slot, when the first and second connecting portions are assembled to each other, the engaging member and the main body are co-rotatable, and the hook is engaged with the slot.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
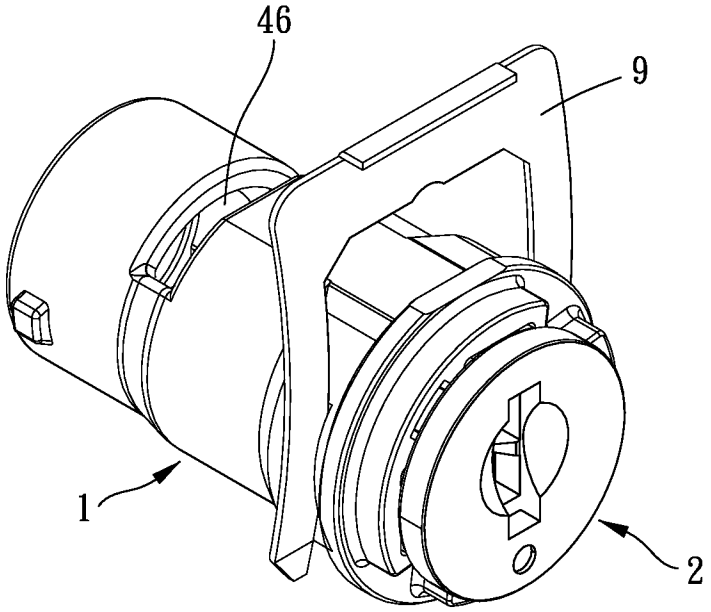
FIG. 1 is a stereogram of a preferred embodiment of the present invention.
Figure 2:
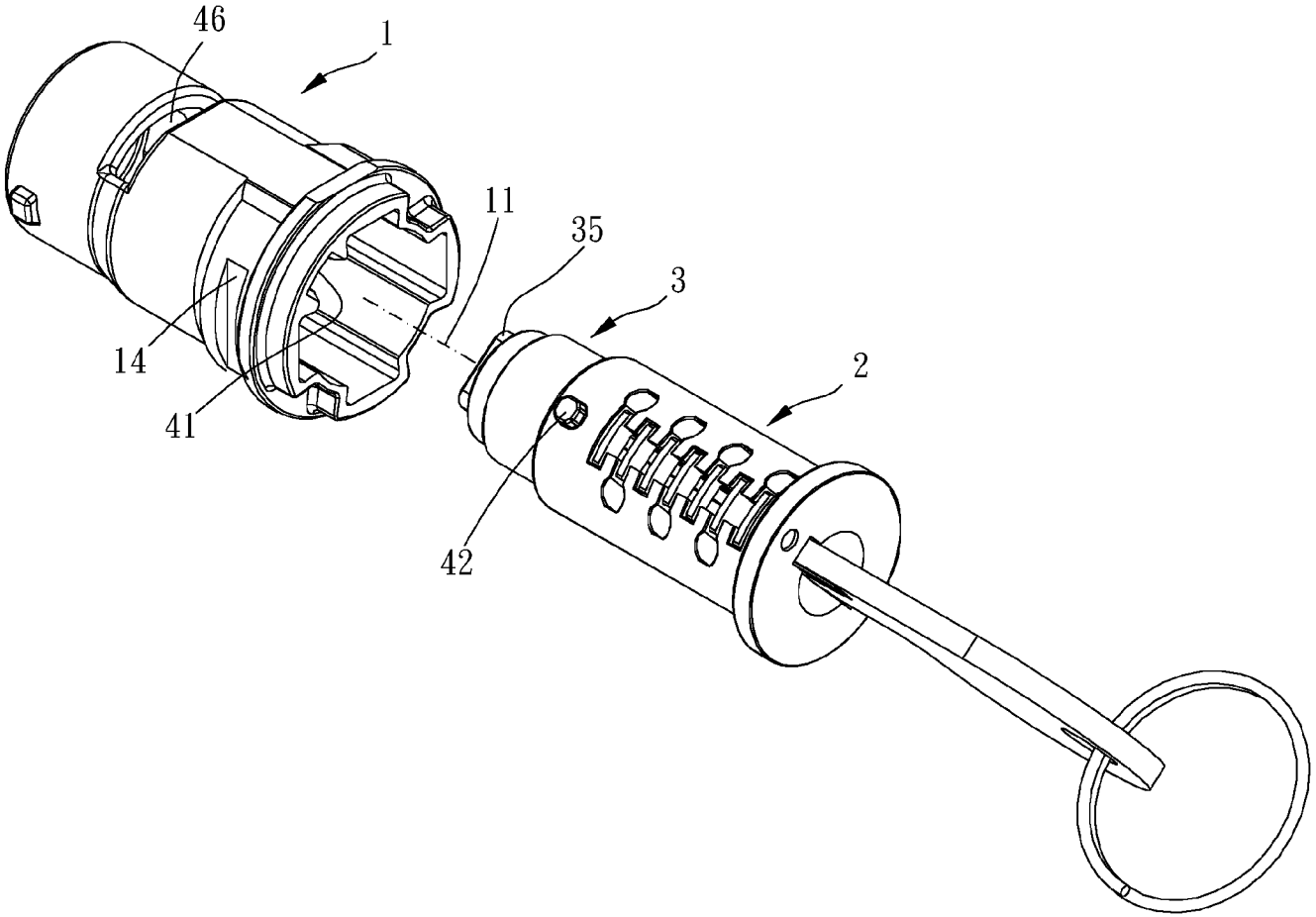
FIG. 2 is a disassembly drawing of the preferred embodiment of the present invention.
Figure 3:
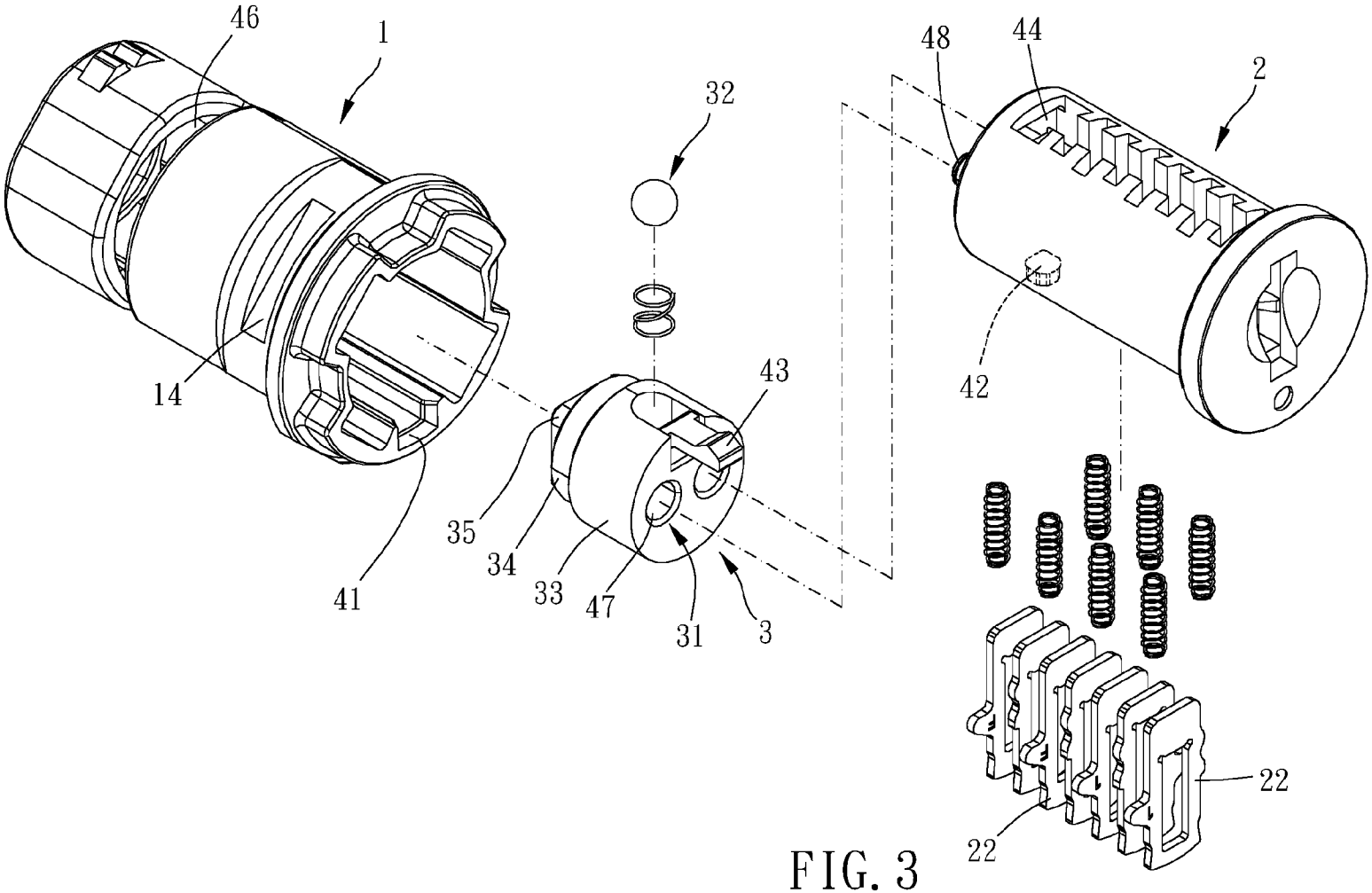
FIG. 3 is a breakdown view of the preferred embodiment of the present invention.
Figure 5:
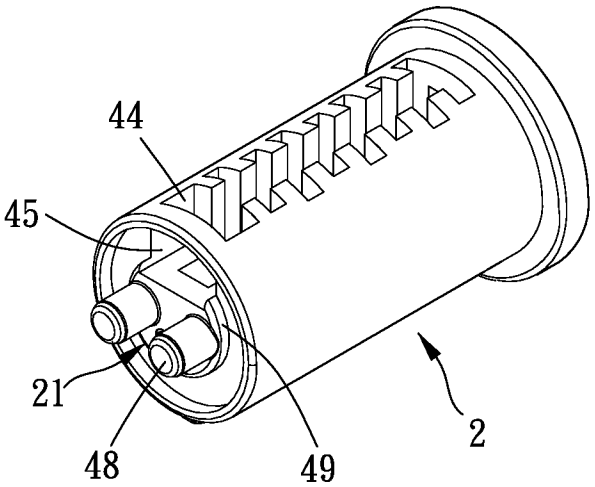
FIGS. 4 and 5 are stereograms of a main body of the present invention.
Figure 4:
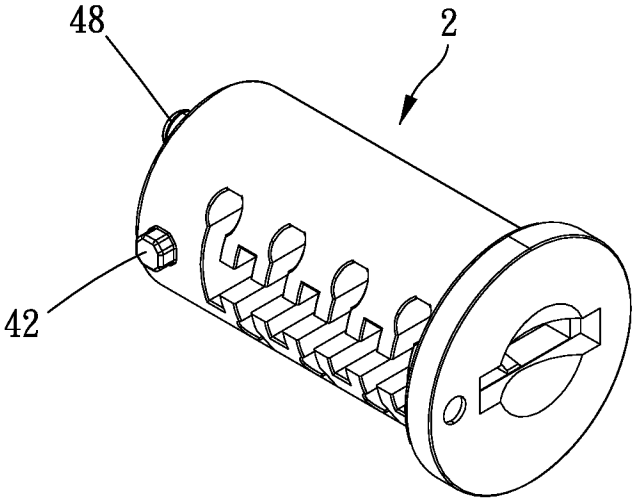
Figure 6:
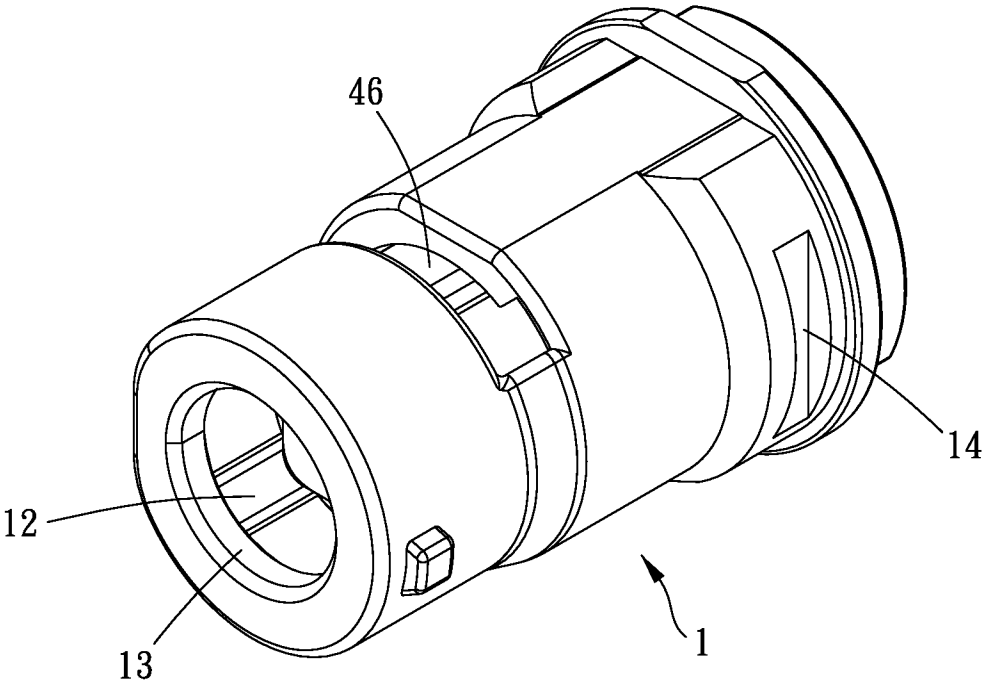
FIGS. 6 and 7 are stereograms of a sleeve member of the present invention.
Figure 8:
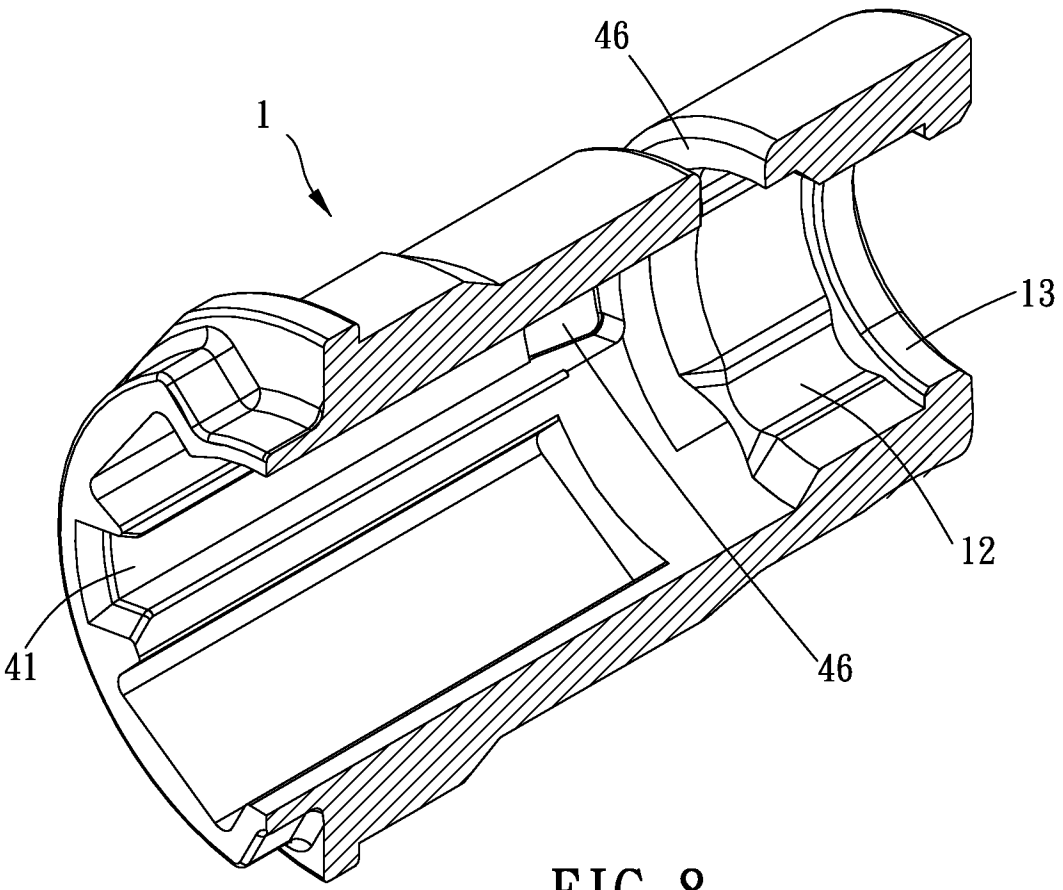
FIG. 8 is a cross-sectional view of the sleeve member of the present invention.
Figure 7:
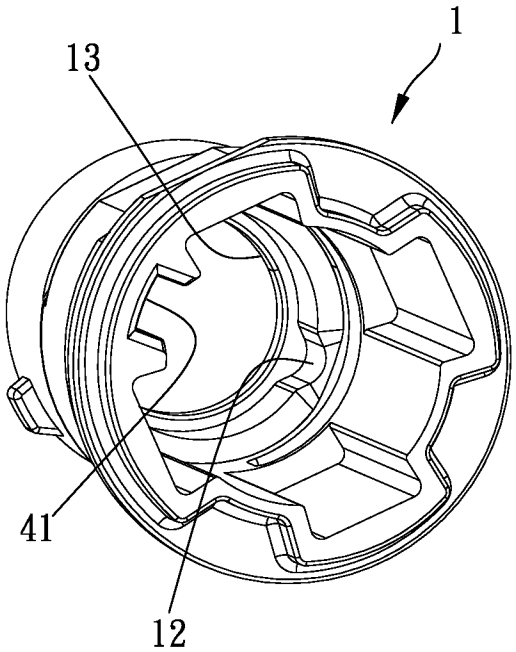
Figure 9:
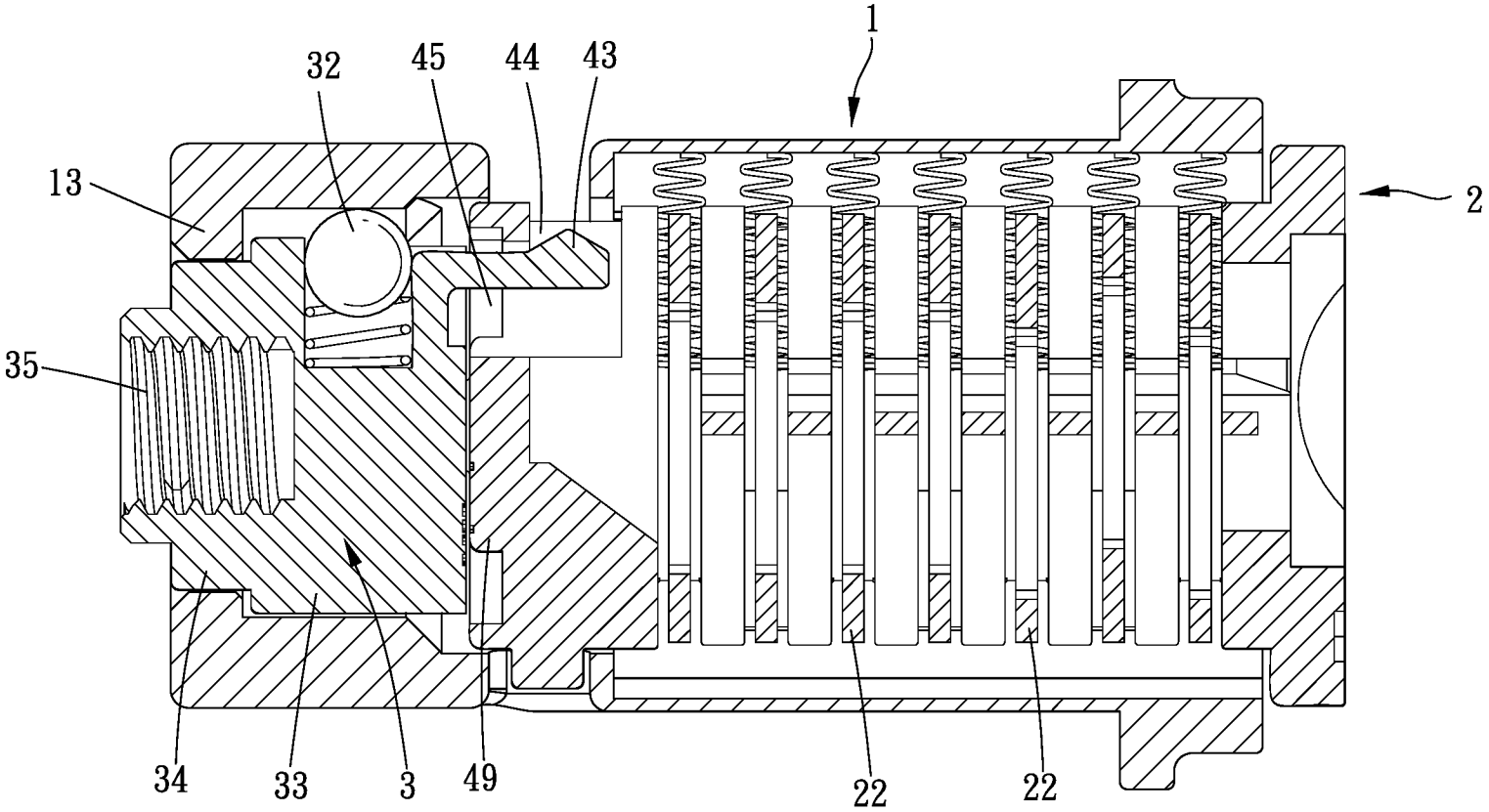
FIG. 9 is a cross-sectional side view of the preferred embodiment of the present invention.

The present invention will be clearer from the following description when viewed together with the accompanying drawings, which show, for purpose of illustrations only, the preferred embodiment in accordance with the present invention.

Please refer to FIGS. 1 to 13 for a preferred embodiment of the present invention, a lock includes a sleeve member 1, a main body 2 and an engaging member 3.

The sleeve member 1 defines an axial direction 11 and is for being fixed on an object 9, in this embodiment, two opposite sides of an outer wall of the sleeve member 1 respectively have an engaging slot 14 for the object 9 to be engaged therewith, and the object 9 can be fixedly disposed on carriers such as a desk or a closet so as to fix the sleeve member 1 on one of the carriers aforementioned but not limited thereto.

The main body 2 is rotatably disposed in the sleeve member 1 and has a first connecting portion 21, one of an outer wall of the main body 2 and an inner wall of the sleeve member 1 has a slide slot 41 which extends along the axial direction 11, the other of the outer wall of the main body 2 and the inner wall of the sleeve member 1 has a protrusive block 42, when the protrusive block 42 corresponds to the slide slot 41 in the axial direction 11, the main body 2 is movable relative to the sleeve member 1 along the axial direction 11 to be detached from the sleeve member 1.

The engaging member 3 is rotatably disposed in the sleeve member 1, one end of the engaging member 3 facing the main body 2 has a second connecting portion 31, one of the engaging member 3 and the main body 2 has a hook 43, the other of the engaging member 31 and the main body 2 has a slot 44, when the first and second connecting portions 21, 31 are assembled to each other, the engaging member 3 and the main body 2 are co-rotatable, and the hook 43 is engaged with the slot 44. Therefore, when the hook 43 is engaged with the slot 44, the main body 2 and the engaging member 3 can be fixed to and comove with each other, and the engaging member 3 can be driven by the main body 2 to be detached from the main body 1, so it is more convenient for disassembly and replacement.

Specifically, the hook 43 extends along the axial direction 11, the slot 44 opens in a radial direction, the slot 44 includes a through hole 45 which extends along the axial direction 11, and the hook 43 protrudes into the through hole 45 and is engaged with the slot 44. In this embodiment, the hook 43 is disposed on the engaging member 3, the slot 44 and the through hole 45 are disposed on the main body 2, and in other embodiments, arrangements of the hook 43, the slot 44 and the through hole 45 can be switched, and the main body 2 and the engaging member 3 can still be fixed relative to each other.

In addition, one end of the slide slot 41 in the axial direction 11 has a curved groove 46 which communicates with the slide slot 41, the curved groove 46 extends circumferentially, and when the main body 2 is inserted into the sleeve member 1, and the protrusive block 42 slides along the slide slot 41 to the curved groove 46, the protrusive block 42 is slidable along the curved groove 46, and the main body 2 is rotatable relative to the sleeve member 1. In this embodiment, the curved groove 46 and the slide slot 41 are disposed on the sleeve member 1, the protrusive block 42 is disposed on the main body 2, the curved groove 46 is disposed through the sleeve member 1, so when the sleeve member 1 is manufactured, an outer wall of the sleeve member 1 can be processed and penetrated to form the curved groove 46, which is to be made. In other embodiments, the slide slot 41 and the curved groove 46 which are disposed through the sleeve member 1 can switch position with the protrusive block 42 which is disposed on the main body 2, and the main body 2 can similarly move and rotate relative to the sleeve member 1. However, the curved groove may be a blind groove or hole disposed on an inner wall of the sleeve member.

Preferably, one of the first and second connecting members 21, 31 has at least two insertion holes 47 in the axial direction 11, the other of the first and second connecting members 21, 31 has at least two insertion members 48 in the axial direction 11, in this embodiment, there are two said insertion holes 47 and two said insertion members 48, and each of the two insertion members 48 is inserted in one of the two insertion holes 47 so that the main body 2 and the engaging member 3 can comove with each other to rotate. In this embodiment, one of the two ends of the main body 2 facing the engaging member 3 has the first connecting portion 21, the first connecting portion 21 has a flange 49 toward the engaging member 3, the two insertion members 48 extend beyond the flange 49, and when each of the two insertion members 48 is inserted in one of the two insertion members 47, the flange 49 abuts against the engaging member 3, and the flange 49 can increase a structural strength of the two insertion members 48.

The inner wall of the sleeve member 1 further has a block edge 13, the three recesses 12 are located between the block edge 13 and the slide slot 41, and a diametric dimension of the engaging member 3 is greater than a hole diameter which is defined by the block edge 13. In addition, in this embodiment, the engaging member 3 includes a radially-widened section 33 and a radially-narrowed section 34, the radially-widened section 33 is connected with one end of the radially-narrowed section 34 toward the main body 2, the elastic abutting member 32 is arranged in the radially-widened section 33, the second connecting portion 31 is near the radially-widened section 33, the radially-narrowed section 34 is disposed through the block edge 13, and a diametric dimension of the radially-widened section 33 is greater than a hole diameter which is defined by the block edge 13 so that the block edge 13 can positioningly block the radially-widened section 33 to prevent the engaging member 3 from being detached from the sleeve member 1.

Specifically, one end of the main body 2 remote from the engaging member 3 is for a key to be inserted thereinto, the main body 2 further has a plurality of lock core sheets 22, when the key is inserted into the main body 2, the key abuts against each of the plurality of lock core sheets 22, and the plurality of lock core sheets 22 submerge into the main body 2 so that the main body 2 can rotate relative to the sleeve member 1; another end of the engaging member 3 remote from the main body 2 has an assembling portion 35, the assembling portion 35 is for being assembled to a block member, and the blocking member is configured to prevent the object 9 from being opened or moved so as to provide an anti-theft function.

Figure 11:
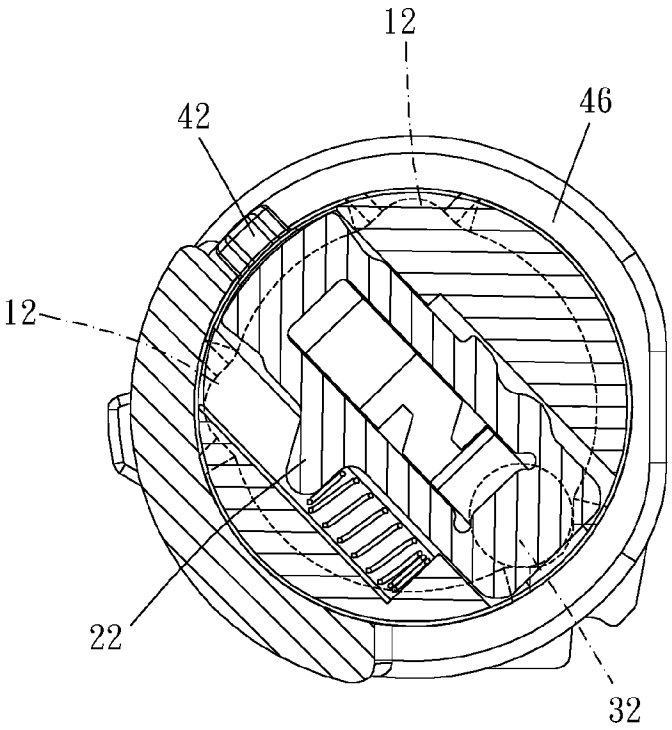
FIGS. 11 to 13 are drawings showing the preferred embodiment of the present invention in operation.
Figure 10:
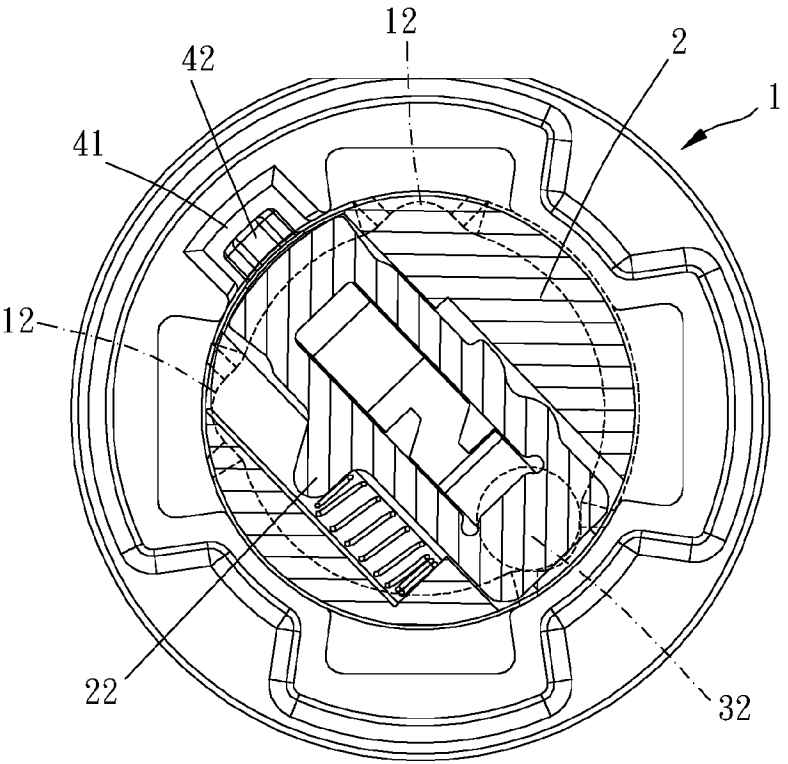
FIG. 10 is a cross-sectional view of the preferred embodiment of the present invention taken in an axial direction.
Figure 13:
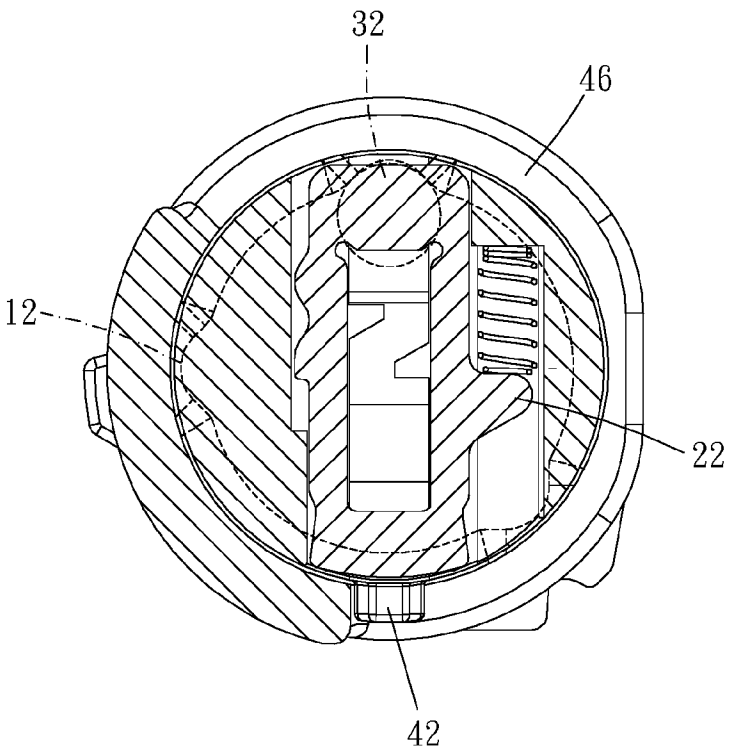
Figure 12:
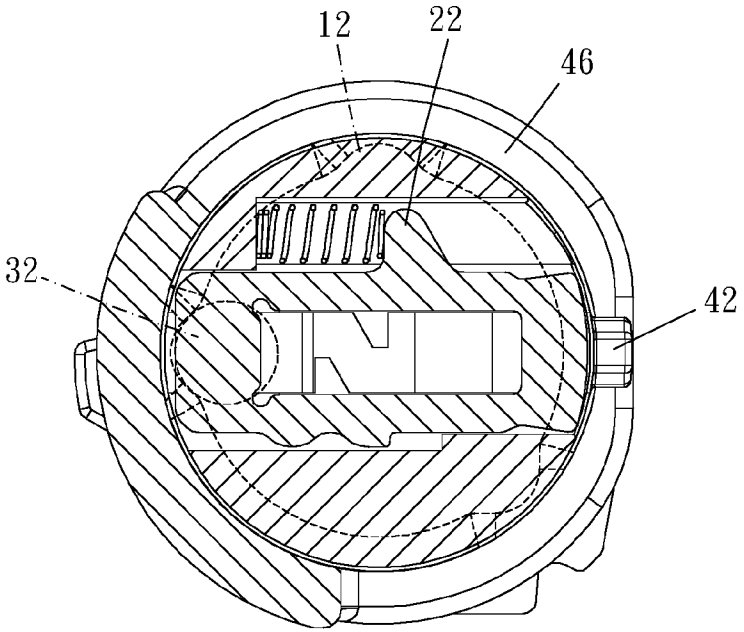

It is to be noted that an exterior circumferential wall of the engaging member 3 has an elastic abutting member 32, an interior circumferential wall of the sleeve member 1 has three recesses 12, the elastic abutting member 32 abuts outwardly against the inner wall of the sleeve member 1, when the main body 2 rotates relative to the sleeve member 1, the elastic abutting member 32 is detachably engaged within one of the three recesses 12, the main body 2 is rotatable relative to the sleeve member 1 to be on a disassembling position (as shown in FIGS. 10 and 11), an unlocked position (as shown in FIG. 12) and a locked position (as shown in FIG. 13); when the main body 2 rotates to the disassembling position, the protrusive block 42 corresponds to the slide slot 41 in the axial direction 11 to extract the main body 2 from the sleeve member 1; when the main body 2 rotates to one of the locked position, the unlocked position and the disassembling position, and the elastic abutting member 32 is engaged within one of the three recesses 12; when the elastic abutting member is engaged within one of the three recesses 12, a vibration transmitted from the key and an impact sound of the elastic abutting member 32 can inform a user that the main body 2 has been rotated to one of the locked position, the unlocked position and the disassembling position.

Given the above, when the main body rotates to make the protrusive block axially corresponds to the slide slot, the main body can be inserted into or pulled out from the sleeve member, so the main body can be replaced without the sleeve member and the object being disassembled together. In addition, when the hook is engaged with the slot, the main body and the engaging member can be fixed to and comove with each other, and the engaging member can comove with the main body to detach from the sleeve member so that it is more convenient for disassembling and replacement.

While we have shown and described various embodiments in accordance with the present invention, it should be clear to those skilled in the art that further embodiments may be made without departing from the scope of the present invention.

What is claimed is:

1. A lock, including:

a sleeve member, defining an axial direction and for being fixed on an object;

a main body, rotatably disposed in the sleeve member, having a first connecting portion, one of an outer wall of the main body and an inner wall of the sleeve member having a slide slot which extends along the axial direction, the other of the outer wall of the main body and the inner wall of the sleeve member having a protrusive block, when the protrusive block corresponds to the slide slot in the axial direction, the main body is movable relative to the sleeve member along the axial direction to be detached from the sleeve member;

an engaging member, rotatably disposed in the sleeve member, one end of the engaging member facing the main body having a second connecting portion, one of the engaging member and the main body having a hook, the other of the engaging member and the main body having a slot, when the first and second connecting portions are assembled to each other, the engaging member and the main body are co-rotatable, and the hook is engaged with the slot;

wherein one end of the slide slot in the axial direction has a curved groove which communicates with the slide slot, the curved groove extends circumferentially, and when the main body is inserted into the sleeve member and the protrusive block slides along the slide slot to the curved groove, the protrusive block is slidable along the curved groove, and the main body is rotatable relative to the sleeve member;

wherein the hook is releasable from the slot such that the engaging member is detachable from the main body;

wherein the engaging member is rotatable with the main body relative to the sleeve member and is detachable from the sleeve member;

wherein when the protrusive block corresponds to the slide slot in the axial direction, the engaging member is withdrawable together with the main body from the sleeve member in a direction from the engaging member toward the main body.

2. The lock of claim 1, wherein the hook extends along the axial direction, the slot opens along a radial direction, the slot includes a through hole which extends along the axial direction, and the hook protrudes into the through hole and is engaged with the slot.

3. The lock of claim 1, wherein the curved groove and the slide slot are disposed on the sleeve member, the protrusive block is disposed on the main body, and the curved groove is disposed through the sleeve member.

4. The lock of claim 1, wherein one of the first and second connecting members has at least two insertion holes in the axial direction, the other of the first and second connecting members has at least two insertion members in the axial direction, and each of the two insertion members is inserted in one of the two insertion holes.

5. The lock of claim 4, wherein one end of the main body facing the engaging member has the first connecting portion, the first connecting portion has a flange toward the engaging member, and the two insertion members extend beyond the flange.

6. The lock of claim 1, wherein an exterior circumferential wall of the engaging member has an elastic abutting member, an interior circumferential wall of the sleeve member has three recesses, the elastic abutting member abuts outwardly against the inner wall of the sleeve member, when the main body rotates relative to the sleeve member, the elastic abutting member is detachably engaged within one of the three recesses, the main body is rotatable relative to the sleeve member to be on a disassembling position, an unlocked position and a locked position, when the main body rotates to the disassembling position, the protrusive block corresponds to the slide slot in the axial direction, and when the main body rotates to one of the locked position, the unlocked position and the disassembling position, the elastic abutting member is engaged within one of the three recesses.

7. The lock of claim 6, wherein the inner wall of the sleeve member further has a block edge, the three recesses are located between the block edge and the slide slot, and a diametric dimension of the engaging member is greater than a hole diameter which is defined by the block edge.

8. The lock of claim 7, wherein the engaging member includes a radially-widened section and a radially-narrowed section, the radially-widened section is connected with one end of the radially-narrowed section toward the main body, the elastic abutting member is arranged in the radially-widened section, the second connecting portion is near the radially-widened section, the radially-narrowed section is disposed through the block edge, and an diametric dimension of the radially-widened section is greater than a hole diameter which is defined by the block edge.

9. The lock of claim 1, wherein one end of the main body remote from the engaging member is for a key to be inserted thereinto, the main body further has a plurality of lock core sheets, when the key is inserted into the main body, the key abuts against each of the plurality of lock core sheets, and the plurality of lock core sheets submerge into the main body; another end of the engaging member remote from the main body has an assembling portion, and the assembling portion is for being assembled to a block member; two opposite sides of an outer wall of the sleeve member respectively have an engaging slot for the object to be engaged therewith.

* * * * *